US006401434B1

(12) United States Patent
Sims

(10) Patent No.: US 6,401,434 B1
(45) Date of Patent: Jun. 11, 2002

(54) METHOD AND APPARATUS FOR LOADING FILLED FRUIT PACKING TRAYS

(75) Inventor: Russel E. Sims, Yakima, WA (US)

(73) Assignee: Michelsen Packaging Company, Yakima, WA (US)

( * ) Notice: Subject to any disclaimer, the term of this patent is extended or adjusted under 35 U.S.C. 154(b) by 0 days.

(21) Appl. No.: 09/454,059

(22) Filed: Dec. 2, 1999

(51) Int. Cl.[7] ..... B65B 5/06; B65B 35/30

(52) U.S. Cl. ..... 53/445; 53/474; 53/475; 53/238; 53/244; 53/250

(58) Field of Search ..... 53/445, 448, 474, 53/475, 157, 238, 250, 244, 247, 534

(56) References Cited

U.S. PATENT DOCUMENTS

| | | | | |
|---|---|---|---|---|
| 2,524,846 A | * | 10/1950 | Socke | 53/244 |
| 2,797,540 A | * | 7/1957 | Carlsen | 53/244 |
| 2,843,496 A | | 7/1958 | Altenburg et al. | 99/171 |
| 2,946,164 A | * | 7/1960 | Potts | 53/448 |
| 2,957,287 A | * | 10/1960 | Cella | 53/250 |
| 3,040,923 A | | 6/1962 | Leitzel | 217/26.5 |
| 3,221,971 A | | 12/1965 | Reny | 229/2.5 |
| 3,224,569 A | | 12/1965 | Leitzel | 206/45.31 |
| 3,245,570 A | | 4/1966 | Friday | 217/26 |
| 3,334,765 A | | 8/1967 | Modersohn | 217/26.5 |
| 3,352,477 A | | 11/1967 | Eisenberg | 229/40 |
| 3,416,690 A | | 12/1968 | Michael | 217/26.5 |
| 3,651,976 A | | 3/1972 | Chadbourne | 220/23.4 |
| 3,715,071 A | | 2/1973 | Flynn | 229/2.5 |
| 3,732,976 A | | 5/1973 | Bessett et al. | 206/65 R |
| 3,749,235 A | | 7/1973 | Boursier | 206/45.31 |
| 3,843,009 A | | 10/1974 | Emery | 217/26.5 |
| 3,902,622 A | | 9/1975 | Emery | 217/26.5 |
| 3,907,161 A | | 9/1975 | Martin | 221/211 |
| 3,910,411 A | | 10/1975 | Deeren | 206/422 |
| 3,997,057 A | | 12/1976 | Craig | 206/507 |
| 4,012,530 A | | 3/1977 | Holden | 426/124 |
| 4,088,259 A | | 5/1978 | Sutton | 229/2.5 EC |
| 4,101,049 A | | 7/1978 | Wallace et al. | 229/2.5 R |
| 4,149,355 A | * | 4/1979 | Clegg | 53/448 |
| 4,195,743 A | | 4/1980 | Emery | 217/265 |
| 4,305,691 A | | 12/1981 | Mayer | 414/128 |
| 4,328,908 A | | 5/1982 | Temming | 221/213 |
| 4,333,571 A | | 6/1982 | Martelli | 206/499 |
| 4,355,731 A | | 10/1982 | Carroll et al. | 217/26.5 |
| 4,448,344 A | | 5/1984 | Lord et al. | 229/2.5 EC |
| 4,448,640 A | | 5/1984 | Brault et al. | 162/218 |
| 4,465,225 A | | 8/1984 | Bixler et al. | 229/2.5 EC |
| 4,636,392 A | | 1/1987 | Toshitsugu | 426/110 |
| 4,686,813 A | * | 8/1987 | Sawada | 53/543 |
| 4,759,935 A | | 7/1988 | Toshitsugu | 426/110 |
| 4,789,291 A | | 12/1988 | Allan | 414/128 |
| 4,800,703 A | * | 1/1989 | Goodman | 53/244 |
| 4,821,901 A | | 4/1989 | Bixler | 217/18 |
| D304,678 S | | 11/1989 | Vigue | D9/341 |
| D327,841 S | | 7/1992 | Letourneau | D9/348 |
| 5,205,410 A | | 4/1993 | Kuipers et al. | 206/386 |
| 5,533,623 A | | 7/1996 | Fischer | 206/518 |
| 5,597,073 A | | 1/1997 | Kocis | 206/564 |
| D396,408 S | | 7/1998 | Carver | D9/345 |
| 5,827,068 A | | 10/1998 | Sims | 414/795.6 |
| 5,876,180 A | | 3/1999 | Sims | 414/795.6 |

FOREIGN PATENT DOCUMENTS

JP 52-43268 5/1977

* cited by examiner

*Primary Examiner*—John Sipos
(74) *Attorney, Agent, or Firm*—Seed Intellectual Property Law Group PLLC

(57) ABSTRACT

An apparatus and method for loading packing trays filled with fruit or vegetables into a packing carton. The apparatus can include a frame, a carton loading station to support the packing carton, and a tray engaging member configured to engage the selected tray and move the selected tray into the carton. In one embodiment, the tray engaging member is coupled to a tray head that is movable relative to the frame to place the tray into the packing carton. A pad inserter, movably coupled to the frame, inserts a cushioning pad above each tray after the tray is loaded into the carton.

40 Claims, 4 Drawing Sheets

METHOD AND APPARATUS FOR LOADING FILLED FRUIT PACKING TRAYS

TECHNICAL FIELD

The present invention is directed to methods and apparatuses for loading filled fruit packing trays into cartons, boxes, or other containers.

BACKGROUND OF THE INVENTION

Shipment of fruit, such as apples, requires packing the fruit so it is not bruised or otherwise damaged while the fruit is in transit. Damage to the fruit may result if the fruit is packed too tightly or packed so loosely that the fruit can be jarred into sudden contact with the walls of its container or other fruit. Typically, fruit such as apples are packed in paper fiber trays that have cups shaped and sized for retaining the apples to minimize movement of the apples relative to the trays. The trays are shaped so that when filled with apples or other fruit, they may be stacked one upon another in a packing carton for shipment.

In one conventional packing method, the fruit packing trays are filled with apples by hand and the filled trays move on a conveyor belt to a boxing station. At the boxing station, workers manually pick up each filled apple tray and load the trays one by one into cartons for shipment. In one aspect of this conventional method, a machine inserts cushioning pads between each tray in the carton to further cushion and protect the fruit. An automated device with suction cups is typically used to place a top pad on the top-most tray before the carton is sealed.

One drawback with this conventional method is that manually loading the filled trays into packing cartons is a time-consuming, labor-intensive and expensive activity. Accordingly, one approach to addressing the foregoing problem has been to automatically place an empty fruit packing tray in the carton using automated suction cups that engage the tray and release the tray into the carton. The apples are then individually, automatically deposited in the tray using automated suction cups that engage the apples and release the apples into the cups of the tray. Once the tray is full, a cushioning pad is automatically positioned on the filled tray and the next empty tray is automatically positioned on top of the cushioning pad. The next tray is then automatically filled with apples in a similar manner.

One problem with this automated approach is that loading apples individually into the trays with suction cups can be a time-consuming process and the suction cups can damage the apples, particularly if the apples (or another fruit) are soft. Furthermore, the suction cups do not orient the apples in a uniform manner, so that the arrangement of apples in the trays is not consistent, which may be unappealing to consumers. Still a further drawback is that the automatic process does not allow for a final quality control check of each apple just before the apple is placed in the tray. Yet a further drawback is that the automatic device is relatively large and may not be fit into existing apple processing facilities without substantially altering existing processing lines.

SUMMARY OF THE INVENTION

The present invention is directed to methods and apparatuses for loading packing cartons with packing trays filled with fruit or vegetables. In one embodiment, the apparatus includes a frame and a carton loading station proximate to the frame and configured to support the packing carton in a selected position. The apparatus can further include at least one tray engaging member coupled to the frame and movable relative to the frame and the carton loading station between a first position and a second position. In the first position, the tray engaging member is spaced apart from the packing carton to engage a selected filled fruit packing tray and in the second position, the tray engaging member is proximate to the packing carton to load the selected filled tray into the packing carton.

In one embodiment, the tray engaging member can be one of a plurality of tray engaging members coupled to a tray head that moves upwardly and downwardly with the tray engaging members relative to the packing carton between the first and second positions. Each tray engaging member can have an elongated shaft with a tapered end portion for engaging the selected tray. The tray engaging members are pivotable relative to the tray about a rotation axis between an engaged position with the tray engaging members engaging the selected tray and a disengaged position with the tray engaging members disengaged from the selected tray. In a further aspect of this embodiment, the tray engaging members are coupled to first and second portions of the tray head. The first portion of the tray head is pivotable relative to the second portion to spread the tray engaging members apart around the selected filled tray as the tray head engages the selected filled tray.

A method in accordance with an embodiment of the invention includes engaging a selected filled fruit packing tray with a tray engaging member of a carton loading apparatus, positioning the tray proximate to an opening of a packing carton, and moving the tray engaging member and the selected tray as a unit toward the carton to position the selected tray within the carton. The method can further include releasably engaging a cushioning pad with an inserter apparatus and releasing the cushioning pad onto the filled fruit packing tray when the filled fruit packing tray is in the carton.

DETAILED DESCRIPTION OF THE INVENTION

The present invention is directed toward devices and methods for loading filled packing trays, such as fruit packing trays, into a carton, box or other container. The device includes a tray head having movable tray engaging members that engage the filled packing tray and move the tray into the carton. The device also inserts cushioning pads between the filled packing trays in the carton. The specific details of certain embodiments of the invention are set forth in the following description and in FIGS. 1–4 to provide a thorough understanding of such embodiments. One skilled in the art, however, will understand that the present invention may have additional embodiments and that they may be practiced without several of the details described in the following description.

Figure 1:
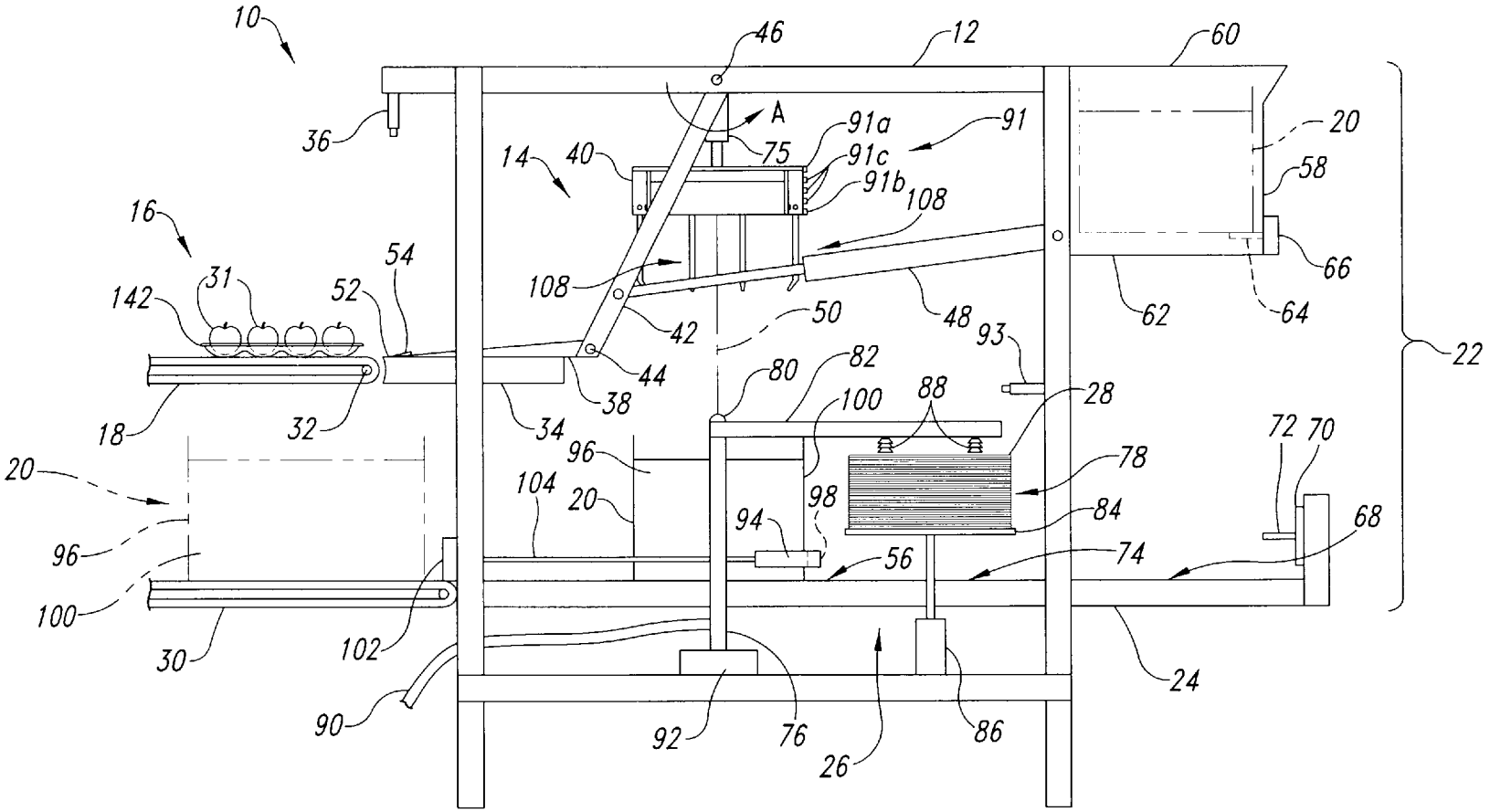
FIG. 1 is a side elevational view of an apparatus having a tray head for loading filled fruit packing trays in a carton in accordance with an embodiment of the invention.

FIG. 1 is a side elevational view of an apparatus 10 having a frame 12 that supports a tray positioner 14. The tray positioner 14 is movable relative to the frame 12 to receive a filled packing tray 16 from a tray conveyor 18 and load the packing tray into a carton 20 positioned below the tray positioner. The apparatus 10 further includes a carton loader 22 that delivers the empty carton 20 to a carton support 24 located beneath the tray positioner 14 for filling with packing trays. The tray positioner 14 deposits the filled packing tray 16 into the carton 20 and a pad inserter 26 places a cushioning pad 28 on top of the filled tray when the filled tray is within the carton 20. The foregoing steps are repeated until the carton 20 has been loaded to capacity with filled trays 16. The loaded carton 20 is then moved to a loaded carton conveyor 30 which transports the loaded carton to other stations (not shown) for sealing, labeling, and delivery.

In one embodiment, the filled trays 16 are configured to hold fruit such as apples 31, in a manner generally similar to that disclosed in U.S. Pat. No. 5,827,068, incorporated herein by reference. In other embodiments, the trays 16 have other shapes and configurations for holding apples or other fruits, vegetables or food items.

In one embodiment, the tray conveyor 18, which transports the filled trays 16 to the tray positioner 14, includes a conventional device having a belt wrapped around a pair of rollers 32, one of which is visible in FIG. 1. Alternatively, the tray conveyor 18 can include other devices, such as a plurality of parallel, closely spaced rollers. In either case, the filled tray 16 exits the tray conveyor 18 and moves onto a tray platform 34 positioned at the end of the tray conveyor 18, where the filled tray is received by the tray positioner 14. A photodetector 36 or other detection device positioned above the end of the conveyor 18 detects the passage of the filled tray 16 onto the tray platform 34 and can be coupled to the tray positioner 14 to activate the tray positioner.

In the embodiment of FIG. 1, the tray positioner 14 includes a movable tray support 38 that retrieves the filled tray 16 from the tray platform 34 and positions the filled tray beneath a movable tray head 40 of the tray positioner. In one aspect of this embodiment, the tray support 38 is pivotally coupled to a support arm 42 at a support pivot joint 44. The support arm 42 is coupled to the frame 12 at a frame pivot joint 46. A hydraulic or pneumatic arm actuator 48 extends between the support arm 42 and the frame 12 and is retractable to pivot the support arm 42 and the tray support 38 attached thereto about the frame pivot joint 46 (as indicated by arrow A) between a retrieving position (shown in FIG. 1) with the tray support positioned to scoop up the filled tray 16 from the tray platform 34, and an aligned position with the tray support and the filled tray aligned with an axis 50 extending upwardly from the carton 20. The arm actuator 48 is extendable to move the tray support 38 back to the retrieving position to pick up the next filled tray 16 from the tray platform 34.

In a further aspect of this embodiment, the tray support 38 has a relatively sharp leading edge 52 that slides between the tray platform 34 and the filled tray 16 to facilitate placing the tray support under the filled tray. The tray support 38 also has an upward projection 54 that allows the tray support 38 to slide under the filled tray 16, with the filled tray positioned to the right of the projection as viewed in FIG. 1, to thereby restrict subsequent movement of the filled tray toward the tray conveyor 18 so the filled tray does not slide off of the tray support 38 as the tray support moves away from the tray platform 34 toward the aligned position under the tray positioner 14. For example, the projection 54 can have a sloped surface facing the filled tray 16 when the filled tray is on the tray platform 34 and a stepped surface that is moved beyond the filled tray so it engages a lower edge of the filled tray when the filled tray is on the tray support 38. In still a further aspect of this embodiment, the tray support 38 pivots about the support pivot joint 44 (for example, with a four-bar linkage or with a separate actuator) as the support arm 42 pivots about the frame pivot joint 46 to keep the filled tray 16 approximately horizontal as it moves into alignment with the carton 20.

In an alternative embodiment, the tray platform 34 is eliminated and the filled tray 16 exits the tray conveyor 18 and moves directly onto the waiting tray support 38. Because the tray support 38 does not have to pick the filled tray 16 off of the tray platform 34 it does not need the sharp loading edge 52 illustrated in FIG. 1. However, it is necessary to make sure that the tray support 38 is in the tray receiving position generally shown in FIG. 1 when the filled tray 16 passes off of the tray conveyor 18 to avoid it falling and spilling the fruit. In the embodiment not using the tray platform 34, the tray conveyor 18 is hydraulically driven and a valve in the hydraulic system allows the apparatus 10 to stop the tray conveyor 18 if the tray support 38 has not moved back to the tray receiving position to properly receive the next filled tray 16 thereon.

The carton 20 is moved to a loading station 56 beneath the tray positioner 14 by the carton loader 22. In one embodiment, the carton loader 22 includes a hopper 58 having an open top 60 and an open bottom 62. The hopper 58 includes a release bar or retainer 64 to support the empty carton 20 in the hopper (where the carton is shown in phantom lines in FIG. 1). The release bar 64 is coupled to an actuator 66 that moves the release bar between a secure position (shown in FIG. 1) with the release bar extending at least partially across the open bottom 62 and a release position in which the release bar 64 is retracted away from the open bottom 62. In the secure position, the release bar 64 holds the carton 20 in position above a drop station 68, which forms part of the carton support 24. In the release position, the release bar 64 retracts to allow the carton 20 to drop through the open bottom 62 of the hopper 58 and onto the drop station 68 below.

In one embodiment, the drop station 68 can be vertically aligned with the loading station 56, as shown in FIG. 1. The carton loader 22 can include a positioning actuator 70 having a piston 72 that extends laterally toward the loading station 56 to push incoming empty cartons along the carton support 24 from the drop station 68 to a pre-loading station 74 positioned between the drop station 68 and the loading station 56. The carton moving from the drop station 68 to the pre-loading station 74 engages and pushes the carton already at the pre-loading station to the loading station 56 where it is loaded with filled trays 16. In an alternate arrangement, the carton loader 22 can be eliminated and a conveyor (not shown) can supply empty cartons directly to the loading station 56. In other embodiments, the apparatus 10 can include other configurations for delivering empty cartons to the loading station 56.

When the carton 20 is at the loading station 56, the tray head 40 removes the filled tray 16 from the tray support 38 in a manner that will be discussed in greater detail below with reference to FIGS. 2–4. A tray head actuator 75 then lowers the tray head 40 and the filled tray 16 carried by the tray head into the carton 20. Once the filled tray 16 is placed in the carton 20, the pad inserter 26 places one of the pads 28 on top of the fruit 31 in the filled tray (within the carton) to provide a cushion between the fruit and the next packing tray 16 to be placed in the carton.

In one embodiment, the pad inserter 26 includes an upright support 76 attached to the frame 12 and positioned adjacent to a stack 78 of the pads. The upright support 76 is pivotably coupled by a pivot shaft 80 to a transverse arm 82 that extends over the pad stack 78. The pad stack 78 is supported on a stack support 84 which is coupled to a support actuator 86 to move the stack support upwardly and downwardly relative to the transverse arm 82. The transverse arm 82 can include one or more engaging portions, for example, two suction cups 88 coupled to a vacuum source (not shown) by a vacuum conduit 90.

In the operation of the pad inserter 26, the support actuator 86 lifts the pad stack 78 until the uppermost one of the pads 28 contacts the suction cups 88. A vacuum is applied to the vacuum conduit 90 to draw the pad 28 into secure engagement with the suction cups 88. The support actuator 86 then moves the stack support 84 downwardly to separate the uppermost pad 28 from the pad stack 78. An actuator 92, such as an air-driven actuator, pivots the transverse arm 82 about the pivot shaft 80 rearwardly into the plane of FIG. 1 to position the pad 28 held by the suction cups 88 over the open carton 20 at the loading station 56. The vacuum force applied to the suction cups 88 is then reduced so that the pad 28 drops onto the filled tray 16 positioned inside the carton 20.

The tray head 40 and the pad inserter 26 alternately place a filled tray 16 and then a pad 28 in the carton 20 until the carton 20 is filled. The capacity of the carton 20 depends on the size of the carton and the size of the fruit 31 in the filled tray 16. In one embodiment, the depth to which the tray head 40 descends within the carton 20 changes automatically as the carton fills with filled trays 16 so that the tray head does not drive the filled tray it supports downwardly against the filled trays already in the carton, which could damage the fruit 31 the filled trays hold. For example, the tray head 40 can include a plurality of vertically spaced apart reflective strips 91 (such as strips 91*a*, 91*b* and 91*c*) which pass by a photodetector 93 as the tray head descends toward the carton 20. The top-most reflective strip 91*a* is aligned with the photodetector 93 when the tray head 40 is positioned to deposit the first filled tray 16 into the carton 20, the bottom-most reflective strip 91*b* is aligned with the photodetector when the tray head is positioned to deposit the last filled tray 16 into the carton 20, and the intermediate reflective strips 91*c* are sequentially aligned with the photodetector when the tray head is positioned to deposit the several intermediate filled trays. The photodetector 93 detects the reflective strips 91 and accordingly detects the position of the tray head 40 each time the tray head delivers a filled tray 16 to the carton 20. The photodetector 93 is coupled to an electronic circuit (not shown) that counts the number of filled trays 16 placed in the carton 20. The photodetector 93 is also coupled to the tray head actuator 75 to stop the tray head's downward descent when the reflective strip 91 corresponding to the position the filled tray is to have within the carton (i.e., first tray, intermediate tray or last tray) is aligned with the photodetector. In other embodiments, the apparatus 10 can include other arrangements for controlling the motion of the tray head 40.

Once the carton 20 is filled, it moves to the carton conveyor 30. In one embodiment, the apparatus 10 includes an end arm 94 extending along an end 96 of the carton 20 and a side arm 98 extending a short distance along a side 100 of the carton 20 to pull the carton onto the carton conveyor 30. The end arm 94 is coupled to an offloading actuator 102 with a rod 104. When the offloading actuator 102 is activated (drawing the rod 104 from right to left in FIG. 1), the side arm 98 pulls the fully loaded carton 20 onto the carton conveyor 30 (where the carton is shown in phantom lines), while at the same time rotating the carton about 90° so that the side 100 of the carton 20 is aligned with the travel direction of the carton conveyor 30. The carton conveyor 30 can include a conventional belt device, as shown in FIG. 1, or a plurality of closely spaced rollers, or other conveyance devices.

In other embodiments, the apparatus 10 can include other arrangements for removing the loaded cartons 20. For example, the carton conveyor 30 can be positioned behind the frame 12 and the loaded cartons 20 can be moved rearwardly into the plane of FIG. 1 onto the carton conveyor. In a further aspect of this embodiment, the carton conveyor 30 can be a shared conveyor positioned between two frames 12 of the type shown in FIG. 1, one frame being positioned rearwardly behind the other. Each frame 12 is aligned with a separate tray conveyor 18 and has a separate tray positioner 14 to receive filled trays 16 and place the filled trays into cartons 20 which are then moved onto the shared carton conveyor 30. Alternatively, the two frames 12 are joined to form a single frame with two (or more) tray positioners 14. In other embodiments, the apparatus 10 can include other arrangements for moving the loaded cartons 20 from the loading station 56 to the carton conveyor 30.

When the carton 20 is at the loading station 56, the tray support 38 retrieves the loaded tray 16 from the tray platform 34 and swings about the frame pivot joint 46 to center the filled tray 16 over the open carton 20, as discussed above, and within the grasping range of the tray engaging fingers or members 108 of the tray head 40 which project downward and are moveable to grasp the filled tray 16. Once the filled tray 16 is grasped by the tray engaging members 108, the tray support 38 is pivoted about the frame pivot joint 46, down and away from the tray head 40, to the tray platform 34 to retrieve the next filled tray 16. While this occurs the tray head actuator 75 coupled between the tray head 40 and the frame 12 moves the tray head downwardly carrying the grasped filled tray 16 into position over the filled tray 16. The tray head 40 lowers the filled tray it is grasping into the carton 20, as will be discussed in greater detail below with reference to FIGS. 2–4.

Figure 2:
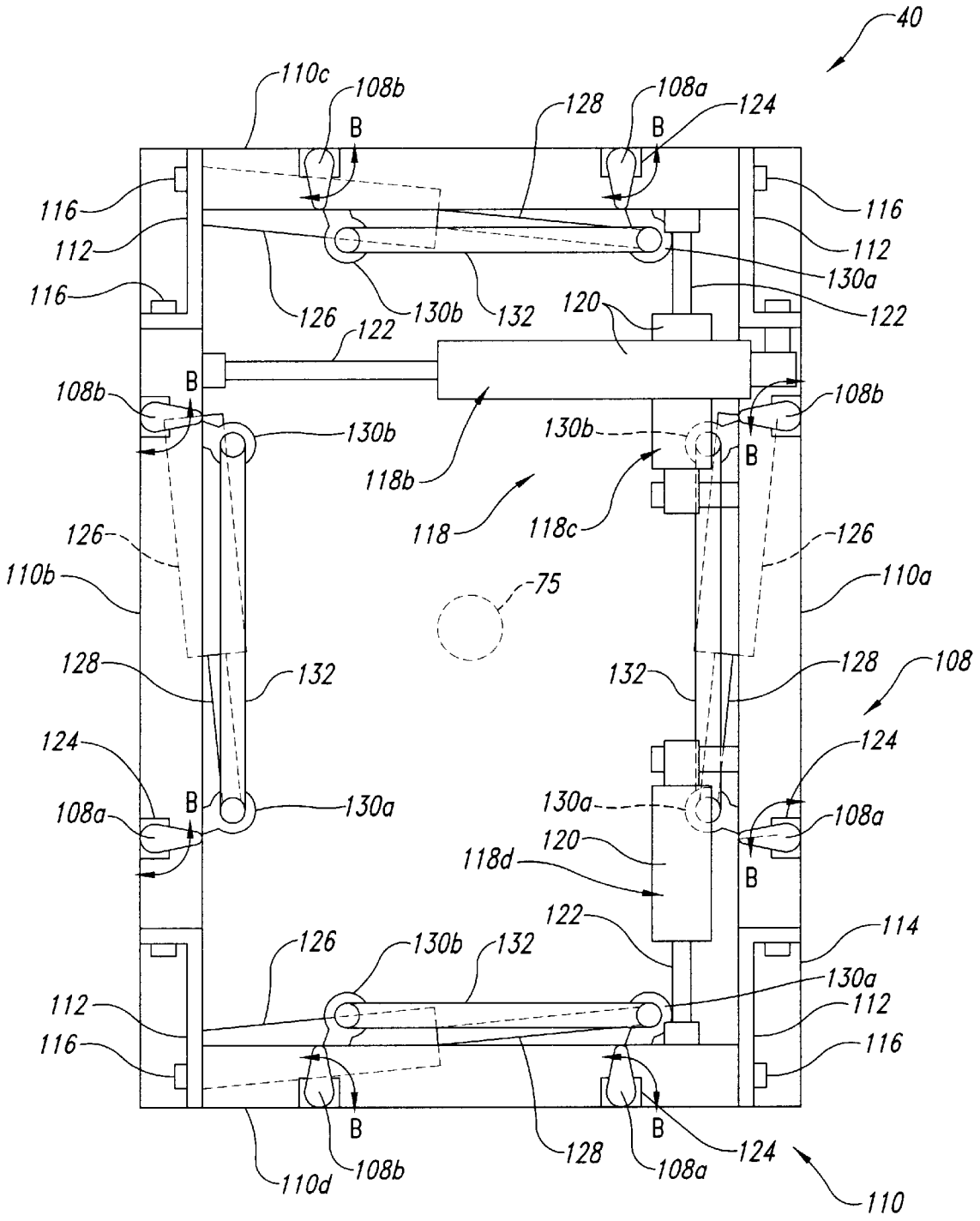
FIG. 2 is an enlarged, bottom plan view of the tray head shown in FIG. 1.

FIG. 2 is a bottom plan view (i.e., looking upwardly) of the tray head 40 shown in FIG. 1. The general arrangement of the tray head 40 is discussed below with reference to FIG. 2 and specific details of the tray head 40 and its operation are discussed further with reference to FIGS. 3 and 4. In one embodiment, the tray head 40 has four sidewalls 110, shown in FIG. 2 as a right sidewall 110*a*, a left sidewall 110*b*, a forward sidewall 110*c*, and a rearward sidewall 110*d*. Corner members 112 are positioned at the corners between the neighboring sidewalls 110 and are attached to a top plate 114 to support the sidewalls 110 relative to each other. The top plate 114 is attached to the tray head actuator 75. In one aspect of this embodiment, the right sidewall 110*a* is fixedly attached to the two corner members 112 between which it is positioned, and the remaining sidewalls 110*b*–110*d* are pivotally coupled at pivot joints 116 to the corner members 112 between which they are positioned.

The tray head 40 further includes three sidewall actuators 118 connected between the fixed right sidewall 110*a* and each of the remaining three sidewalls 110*b*–110*d* to pivot them relative to the right sidewall. Accordingly, the tray head 40 includes a left sidewall actuator 118*b* coupled between the right sidewall 110*a* and the left sidewall 110*b*, a forward sidewall actuator 118*c* coupled between the right sidewall and the forward sidewall 110*c*, and a rearward sidewall actuator 118*d* coupled between the right sidewall and the rearward sidewall 110*d*. The sidewall actuators 118 can be pneumatic, hydraulic, electric or can be powered by other power sources. In one embodiment, each sidewall actuator 118 can include a cylinder 120 coupled to the fixed right sidewall 110*a* and a rod 122 (connected to a piston within the cylinder) extending to the corresponding pivotable sidewall 110*b*–110*d*. The piston rod 122 moves axially between an extended position (shown in FIG. 2) with the sidewalls 110 positioned uprightly, and a retracted position (discussed in greater detail below with reference to FIG. 3) with the sidewalls pivoted relative to the corner members 112 as shown in FIG. 3. In alternate embodiments, the tray head 40 can have other arrangements for moving the sidewalls 110 or the sidewalls can be fixed and the motion of the tray engaging members 108, discussed below, can be sufficient to engage and disengage the filled tray 16 (FIG. 1).

In one embodiment, each sidewall 110 includes at least two of the tray engaging members 108, shown as first tray engaging members 108*a* and second tray engaging members 108*b*. In other embodiments, the tray head 40 can include more or fewer tray engaging members 108. In one embodiment the longer sidewalls 110*b* and 110*c* include three tray engaging members (the third tray engaging members are shown only in FIGS. 3 and 4 in broken line for purposes of clarity). Each tray engaging member 108 extends through and is rotatably disposed in an aperture 124 in the corresponding sidewall 110 and is rotatable about a rotation axis that extends into the plane of FIG. 2, as indicated by arrows B. Each first tray engaging member 108*a* is coupled to an engaging member actuator 126 to rotate the first engaging member 108*a* about its rotation axis. In one embodiment, each engaging member actuator 126 includes an actuator rod 128 pivotably coupled to a tab 130*a* at the upper end of the corresponding first engaging member 108*a*. As the actuator rod 128 moves axially back and forth, it rotates the tab 130*a* and the first engaging member 108*a* connected thereto, as indicated by arrow B. In other embodiments, the first tray engaging member 108*a* can be rotated with other actuator arrangements. In one aspect of the embodiment shown in FIG. 2, the first tray engaging member 108*a* is coupled with a pivot link 132 to a tab 130*b* of the second tray engaging member 108*b* of the same sidewall 110 so that as the first tray engaging member 108*a* rotates about its rotation axis, the second tray engaging member 108*b* rotates in the same direction and by the same amount about the rotation axis of the second tray engaging member.

Figure 3:
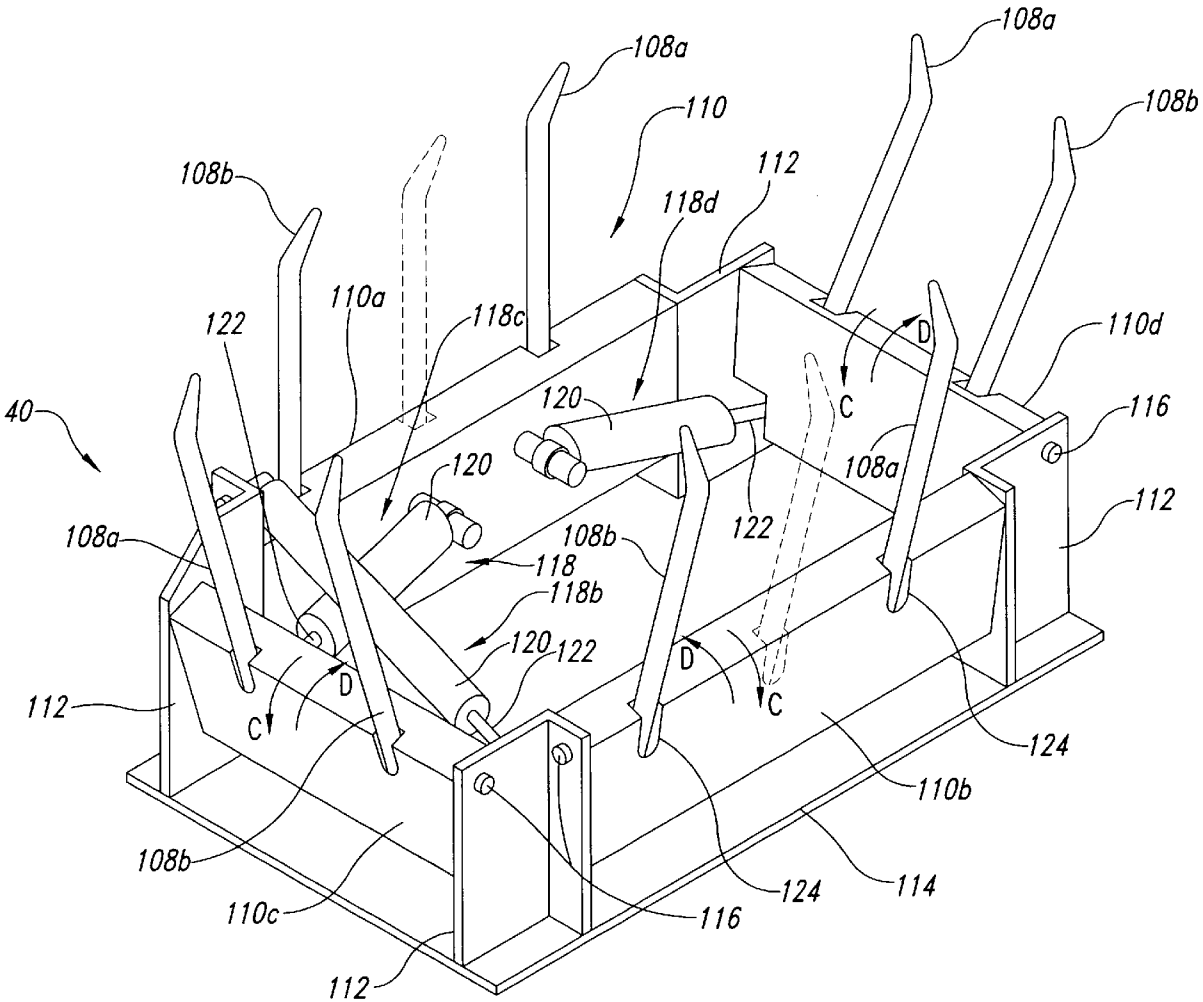
FIG. 3 is an enlarged bottom isometric view of a portion of the tray head shown in FIG. 1 with the sidewalls of the tray head pivoted outwardly.

FIG. 3 is a bottom rear isometric view of the tray head 40 shown in FIGS. 1 and 2. For purposes of illustration, the pivot links 132, the tabs 130*a*, 130*b*, and the engaging member actuators 126 discussed above with reference to FIG. 2 are not shown in FIG. 3 to more clearly show the operation of the sidewalls 110. As shown in FIG. 3, the cylinders 120 of the sidewall actuators 118 are pivotably coupled to the right sidewall 110*a* so as not to bind when the rods 122 extend and retract. The rods 122 of the sidewall actuators 118 move to their retracted positions to pivot the three pivotable sidewalls 110*b*–*d* and the tray engaging members 108 outwardly to an open or receiving position as indicated by arrows C. The three pivotable sidewalls 100*b*–*d* are shown in FIG. 3 with the rods 122 of the sidewall actuators 118 in a partially retracted position. When fully retracted, the three pivotable sidewalls 100*b*–*d* are at an almost 90° angle relative to corner members 112 and the tray engaging members 108 extend laterally outward to permit the tray support 38 to move the filled tray 16 well within the grasping range of the tray engaging members 108 when the three pivotable sidewalls 110*b*–*d* are pivoted back to the position shown in FIG. 4 for grasping of the filled tray 16. Once the filled tray 16 is in position adjacent to the tray head 40, the sidewall actuators 118 pivot the corresponding three sidewalls 110*b*–*d* back to an approximately upright position, as indicated by arrows D, with the tray engaging members 108 approximately vertical in a closed or supporting position, as shown in FIG. 1. The filled tray 16 is now firmly grasped by the tray head 40.

In one aspect of this embodiment, the sidewalls 110 are positioned approximately upright in the closed position, for example, when the lateral dimensions of the filled tray 16 correspond closely to the distance between opposing tray engaging members 108. Alternatively, the opposing pivotable sidewalls 110*b*–*d* and opposing tray engaging members 108 can be canted inwardly in the closed position to accommodate a smaller filled tray 16, or can be canted outwardly in the closed position to accommodate a larger filled tray. Accordingly, the pivotable sidewalls 110*b*–*d* can rotate inwardly until they encounter resistance caused by the tray engaging members 108 contacting the filled tray 16.

Figure 4:
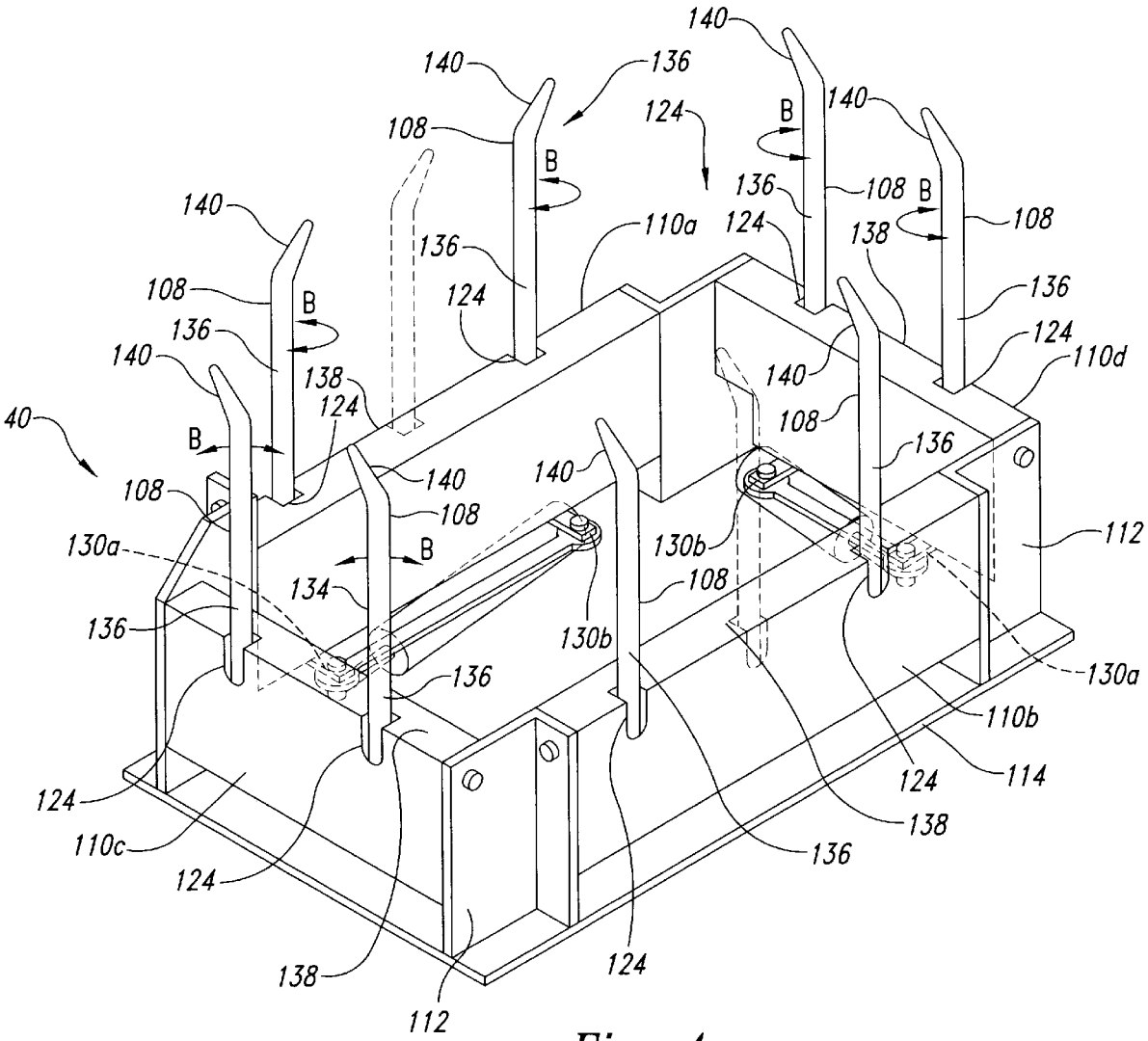
FIG. 4 is another bottom isometric view of the portion of the tray head shown in FIG. 3 with the sidewalls of the tray moved inward.

FIG. 4 is a bottom rear isometric view of the tray head 40 discussed above with reference to FIGS. 1–3 with the sidewalls 110 rotated to the closed position for a standard size tray. For purposes of illustration, the sidewall actuators 118 discussed above with reference to FIGS. 2 and 3 are not shown in FIG. 4 to more clearly show the operation of the tray engaging members 108. Each tray engaging member 108 is in the form of an elongated upright shaft that extends through the aperture 124 in the corresponding sidewall 110. The tray engaging members 108 each have an upper portion (not visible in FIG. 4) projecting through an upper edge of the sidewall 110 and a lower portion 136 projecting through a lower edge 138 of the sidewall. The tabs 130*a*, 130*b* discussed above with reference to FIG. 2 are connected to the upper portion of the tray engaging members. Each of the tray engaging members 108 also has a tapered and canted engaging portion 140 connected to the lower portion 136 thereof.

In one embodiment, the tray engaging members 108, and hence the engaging portions 140, rotate approximately 90° about the shaft axis of the tray engaging members, as indicated by arrow B, between an engaged position in which the engaging portions 140 of the tray engaging members 108 face inwardly toward each other to grasp the edges of the fruit packing tray 16 (FIG. 1) and a disengaged position in which the engaging portions 140 are aligned with the plane of the corresponding sidewall 110. For purposes of illustration, the tray engaging members 108 extending through the forward and rear sidewalls 110*c*, 110*d* are shown in the disengaged position and the tray engaging members extending through the left and right sidewalls 110*a*, 110*b* are shown in the engaged position in FIG. 4. In other embodiments, the tray engaging members 108 rotate through angles different from 90° so long as their engaging portions 140 move between an engaged position in which they engage the filled tray 16 and a disengaged position in which they release the filled tray. In still further embodiments, the tray engaging members 108 can move in a non-pivoting manner between the engaged position and the disengaged position.

Operation of an embodiment of the apparatus 10 is best understood initially with reference to FIG. 1. As was discussed above, the carton 20 is moved to the loading station 56 after passing from the carton loader 22 to the pre-loading station 74 via the drop station 68. Filled fruit packing trays 16 pass from the tray conveyor 18 onto the tray platform 34.

The tray support 38 pivots toward the tray platform 34 such that the leading edge 52 of the tray support 38 slips between the tray platform 34 and the filled tray 16 to lift the filled tray onto the tray support. The tray support 38 then pivots about the frame pivot joint 46 to center the filled tray 16 over the open carton 20 at axis 50. The sidewalls 110 of the tray head 40 are pivoted outwardly to the open position, generally more open than shown in FIG. 3, and the tray engaging members 108 are rotated to their engaged positions, with opposing engaging portions 140 pointed inwardly toward each other. The tray support 38 moves the filled tray 16 through its arcuate path until the filled tray 16 is immediately below and adjacent to the tray head 40, and within the grasping range of the tray engaging members 108 so that when the sidewall actuators 118 are extended the three pivotable sidewalls 110*b–d* rotate in the direction of arrow D in FIG. 3 to bring the tapered engaging portions 140 into position beneath a rim 142 of the filled tray. The sidewalls 110*b–d* pivot toward each other sufficiently to reach a closed position clamping the filled tray 16 between the tray engaging members 108. Alternatively, the filled tray 16 can rest on the engaging portions 140 without being clamped between the engaging members 108.

Once the filled tray 16 has been firmly engaged by the tray head 40, the tray support 38 pivots downward and away from the tray head 40 and returns to the tray platform 34 to retrieve the next filled tray 16. The tray head actuator 75 then lowers the tray head 40 toward the carton 20 until the filled tray 16 rests on the bottom of the carton. Accordingly, the tray engaging members 108 are sufficiently slender so that they will easily fit between the rim 142 of the filled tray 16 and the inside walls of the carton 20 as the filled tray is lowered into the carton. When the filled tray 16 is positioned in the carton 20, the tray engaging members 108 are pivoted to the disengaged position, as was discussed above with reference to FIG. 4, and the tray head actuator 75 moves the tray head 40 upwardly out of the carton 20 to the position shown in FIG. 1. In one aspect of this method, the power to the sidewall actuators 118 (FIGS. 2 and 3) can be interrupted without locking the sidewalls 110 in place, allowing the sidewalls to "float" in place, which makes it easier to extract the tray head 40 from the carton without interfering with the sides of the carton or the filled tray 16.

The pad inserter 26 next positions one pad 28 on top of the fruit 31 in the filled tray 16 within the carton 20, as discussed above, and the foregoing steps are repeated until the carton is filled. The off-loading actuator 102 then pulls the loaded carton 20 on to the carton conveyor 30, as discussed above.

An advantage of an embodiment of the apparatus 10 discussed above with reference to FIGS. 1–4 is that it can automatically load fruit filled packing trays 16 into a carton 20. This is unlike conventional manual methods, which require that workers manually pick up each loaded tray and place it into the carton, a time consuming, strenuous and repetitive activity.

Another feature of the apparatus 10 discussed above with reference to FIGS. 1–4 is that it is relatively compact and can accordingly fit on the end of existing apple processing and packing lines. This is unlike some conventional loading devices which are too large to fit at the end of existing apple packing lines without reconfiguring the lines. Still a further advantage over some conventional automatic packing arrangements is that in a method in accordance with one embodiment of the invention, the packing trays are manually filled before they are placed in the carton, allowing workers to select and orient the fruit in a manner that is attractive to consumers, and does not damage the fruit.

From the foregoing it will be appreciated that, although specific embodiments of the invention have been described herein for purposes of illustration, various modifications may be made without deviating from the spirit and scope of the invention. For example, the apparatus 10 can include photodetectors at various locations (including above the tray platform 34 and adjacent the tray head 40, as shown in FIG. 1) to detect and/or track the location of the trays 16 and/or the cartons 20. The tray positioner 14 and the tray head 40 thereof can have configurations other than those shown in the figures that move the filled trays 16 from the tray conveyor 18 to the carton 20, and the pad inserter 26 can have other configurations that place the pads 28 on the filled trays 16. The trays 16 can be completely or partially filled with fruit, such as apples, or the trays can contain other items. Accordingly, the invention is not limited except as by the appended claims.

I claim:

1. An apparatus for loading filled fruit packing trays into a packing carton, comprising:

a frame;

a carton support coupled to the frame and configured to support the packing carton in a selected position;

a tray head movably coupled to the frame and movable relative to the frame and the carton support between a first position with the tray head spaced apart from the packing carton to engage a selected filled tray and a second position with the tray head proximate to the packing carton to load the selected filled tray into the packing carton; and at least one tray engaging member coupled to the tray head and configured to engage the selected filled tray while the tray head moves from the first position to the second position and disengage the selected filled tray when the tray head is in the second position, the tray engaging member having an elongated shaft with a tapered end portion for engaging the selected filled tray, the shaft being elongated about an axis and being pivotally coupled to the tray head so as to be pivotable relative to the tray about the axis between an engaged position and a disengaged position.

2. The apparatus of claim 1 wherein the tray engaging member is movable relative to the tray head between an engaged position with the tray engaging member positioned to engage the selected filled tray and a disengaged position with the tray engaging member disengaged from the selected filled tray.

3. The apparatus of claim 1 wherein the tray engaging member is pivotable relative to the tray head between an engaged position with the tray engaging member positioned to engage the selected filled tray and a disengaged position with the tray engaging member disengaged from the selected filled tray.

4. The apparatus of claim 1 wherein the tray engaging member is configured to fit between an edge of the selected filled tray and a sidewall of the packing carton when the tray head is loading the selected filled tray into the packing carton.

5. The apparatus of claim 1 wherein the tray engaging member is a first tray engaging member coupled to a movable first portion of the tray head, further comprising a second tray engaging member coupled to a second portion of the tray head, the first portion of the tray head being movable relative to the second portion of the tray head between an open position with the first and second tray engaging members spaced apart from the selected filled tray and a closed position with the tray engaging members engaging the selected filled tray.

6. The apparatus of claim 1 wherein the tray engaging member is a first tray engaging member pivotably coupled to a first portion of the tray head, further comprising a second tray engaging member coupled to a second portion of the tray head, the first portion of the tray head being pivotable relative to the second portion of the tray head between an open position with the first tray engaging member pointing at least partially outwardly to receive the selected filled tray and a closed position with the first tray engaging member pointing at least partially downwardly to engage the selected filled tray.

7. The apparatus of claim 1, further comprising a tray platform coupled to the frame and offset from the tray head and the carton support, the tray platform being positioned at an end of a conveyor to receive the selected filled tray.

8. The apparatus of claim 1, further comprising:

a tray platform coupled to the frame and spaced apart from the tray head and the carton support; and a tray positioning arm having a tray support, the tray positioning arm being movably coupled to the frame and movable between a first position with the tray support at least proximate to the tray platform to engage the selected filled tray when the selected filled tray is supported on the tray platform and a second position with the tray support positioned at least proximate to the tray head to position the selected filled tray engaged by the tray support in position for engaging by the tray engaging member.

9. An apparatus for loading filled fruit packing trays into a packing carton, comprising:

a frame;

a carton support coupled to the frame and configured to support the packing carton in a selected position;

a tray head coupled to the frame and movable relative to the frame and the carton support between a first position with the tray head spaced apart from the packing carton to engage a selected filled tray and a second position with the tray head proximate to the packing carton to load the selected filled tray into the packing carton;

at least one tray engaging member coupled to the tray head and configured to engage the selected filled tray while the tray head moves from the first position to the second position and disengage the selected filled tray when the tray head is in the second position;

a tray platform coupled to the frame and spaced apart from an axis extending between the tray head and the carton support; and a tray positioning arm pivotably coupled to a tray support, the tray support having a generally sharp leading edge to insert between the selected filled tray and the tray platform, the tray support further having a projection to restrict motion of the selected filled tray when the selected filled tray is positioned on the tray platform, the tray positioning arm being pivotably coupled to the frame and pivotable between a first position with the tray support inserted between the tray platform and the selected filled tray and a second position with the tray support positioned proximate to the tray head to position the selected filled tray engaged by the tray support in position for engaging by the tray engaging member.

10. The apparatus of claim 1, further comprising:

a tray positioning arm having a tray support, the tray positioning arm being movably coupled to the frame and movable between a first position with the tray support in position to receive the selected filled tray and a second position with the tray support positioned at least proximate to the tray head to position the selected filled tray engaged by the tray support in position for engaging by the tray engaging member.

11. The apparatus of claim 1, further comprising a conveyor belt positioned adjacent to the carton support to receive the carton after it has been loaded with filled fruit packing trays.

12. The apparatus of claim 1 wherein the carton support is positioned beneath the tray head and the tray head is movable in a downward direction from the first position to the second position.

13. The apparatus of claim 1 wherein the carton is a first carton, the carton support is a first carton support, the tray head is a first tray head, the tray engaging member is a first tray engaging member and the selected filled tray is a first selected filled tray, further comprising:

a second carton support spaced apart from the first carton support and configured to support a second packing carton in a selected position;

a second tray head movable relative to the second carton support between a first position with the tray head spaced apart from a second packing carton to engage a second selected filled tray and a second position with the second tray head proximate to the second packing carton for loading the second selected filled tray into the packing carton;

at least one tray engaging member coupled to the second tray head and configured to engage the second selected filled tray while the second tray head moves from its first position to its second position; and a conveyor positioned between the first and second tray heads to receive the first and second packing cartons after the first and second packing cartons have been loaded with filled fruit packing trays.

14. An apparatus for loading filled fruit packing trays into a packing carton, comprising:

a frame;

a carton support fixedly coupled to the frame and configured to support the packing carton in a selected position;

a tray head movably coupled to the frame and movable upwardly and downwardly along a tray head axis relative to the frame and the carton support between a first position with the tray head spaced apart from the packing carton to engage a selected filled tray and a second position with the tray head proximate to the packing carton to load the selected filled tray into the packing carton, the second position being beneath the first position, the tray head having a first portion and a second portion pivotable relative to the first portion about an axis transverse to the tray head axis between a receiving position to receive the selected filled tray and a supporting position to support the selected filled tray, the first and second portions of the tray head being positioned opposite each other, the tray head further having third and fourth opposing portions between the first and second portions, the second, third and fourth portions being pivotable relative to the first portion; and each of the first, second, third and fourth portions of the tray head having at least a first tray engaging member rotatably coupled to the respective portion of the tray head and pivotable about a first pivot axis between an engaged position with the first tray engaging member supporting at least a portion of the selected filled tray and a disengaged position with the first tray engaging member disengaged from the selected filled tray, and a second tray engaging member rotatably coupled to the respective portion of the tray head and pivotable about a second pivot axis between an engaged position with the second tray engaging member supporting at least a portion of the selected filled tray and a disengaged position with the second tray engaging member disengaged from the selected filled tray.

15. The apparatus of claim 14, further comprising:

a pad inserter pivotably coupled to the frame and having a plurality of vacuum cups coupled to a vacuum source, the pad inserter being movable relative to a stack of pads between a retrieving position with the vacuum cups aligned with the stack of pads and engaged with a top pad of the stack of pads and a disposing position with the vacuum cups aligned with the selected filled tray when the selected filled tray is positioned in the packing carton.

16. The apparatus of claim 14, further comprising a carton loader having a carton retainer movably coupled to an actuator and movable relative to the frame between a support position with the retainer supporting the packing carton and a release position with the retainer disengaged from the carton to release the carton, the carton support having a drop station positioned beneath the carton loader to receive the packing carton when the carton retainer releases the carton and a loading station beneath the tray head to support the carton when the carton receives the selected filled tray.

17. The apparatus of claim 14, further comprising a linear actuator coupled to the frame and positioned proximate to the carton support, the linear actuator having an actuator rod coupled to an engaging arm to engage a surface of the carton and rotate the carton as the actuator rod moves linearly relative to the frame.

18. The apparatus of claim 14 wherein the first tray engaging member of each of the first, second, third and fourth portions of the tray head has an elongated shaft and a tapered engaging portion toward one end of the shaft, the tapered engaging portion being canted relative to an axis of the shaft to engage the selected filled tray.

19. The apparatus of claim 14, wherein at least one of the first, second, third and fourth portions of the tray head has the second tray engaging member spaced apart from the first tray engaging member, with the first and second tray engaging members being coupled together to rotate together and engage the selected filled tray.

20. The apparatus of claim 14, further comprising:

a tray positioning arm having a tray support, the tray positioning arm being movably coupled to the frame and movable between a first position with the tray support in position to receive the selected filled tray and a second position with the tray support positioned at least proximate to the tray head to position the selected filled tray engaged by the tray support in position for engaging by the first and second tray engaging members.

21. The apparatus of claim 20 wherein the tray positioning arm is pivotably coupled to the frame and selectively rotates to move the tray support between the first and second tray support positions.

22. The apparatus of claim 14, further comprising:

a tray platform coupled to the frame and spaced apart from the tray head and the carton support; and a tray positioning arm having a tray support, the tray positioning arm being movably coupled to the frame and movable between a first position with the tray support at least proximate to the tray platform to engage the selected filled tray when the selected filled tray is supported on the tray platform and a second position with the tray support positioned at least proximate to the tray head to position the selected filled tray engaged by the tray support in position for engaging by the first and second tray engaging members.

23. An apparatus for loading packing trays filled with fruits or vegetables into a packing carton, comprising:

a frame;

a carton loading station at least proximate to the frame and configured to support the packing carton in a selected position; and at least one tray engaging member movably coupled to the frame and movable relative to the frame and the carton loading station between a first position with the at least one tray engaging member spaced apart from the packing carton to engage a selected filled tray and a second position with the at least one tray engaging member proximate to the packing carton to load the selected filled tray into the packing carton, the at least one tray engaging member being configured to selectively engage and disengage from the selected filled tray, the at least one tray engaging member having an elongated shaft with a tapered end portion for engaging the selected filled tray, the shaft being elongated about an axis and being pivotable relative to the selected filled tray about the axis between an engaged position and a disengaged position.

24. The apparatus of claim 23 wherein the tray engaging member is movable relative to the frame between an engaged position with the tray engaging member positioned to engage the selected filled tray and a disengaged position with the tray engaging member disengaged from the selected filled tray.

25. The apparatus of claim 23 wherein the carton loading station includes a portion of a carton support fixedly attached to the frame.

26. The apparatus of claim 23 wherein the tray engaging member is a first tray engaging member coupled to a first portion of a tray head movably coupled to the frame to move with the first tray engaging member between the first position and the second position, further comprising a second tray engaging member coupled to a second portion of the tray head, the first portion of the tray head being movable relative to the second portion of the tray head between an open position with the tray engaging members spaced apart from the selected filled tray and a closed position with the tray engaging members engaging the selected filled tray.

27. The apparatus of claim 23, further comprising:

a tray positioning arm having a tray support, the tray positioning arm being movably coupled to the frame and movable between a first position with the tray support in position to receive the selected filled tray and a second position with the tray support positioned proximate to the at least one tray engaging member to position the selected filled tray for engaging by the at least one tray engaging member.

28. The apparatus of claim 27, further including a tray platform to receive the selected filled tray thereon, the tray platform being coupled to the frame and spaced apart from the at least one tray engaging member, and the first position of the tray positioning arm being at least proximate to the tray platform, the tray positioning arm being operable when moved into the first position to pick up the selected filled tray from the tray platform.

29. The apparatus of claim 23 wherein the carton is a first carton, the carton loading station is a first carton loading station, the tray engaging member is a first tray engaging member and the selected filled tray is a first selected filled tray, further comprising:

a second carton loading station spaced apart from the first carton loading station and configured to support a second packing carton in a selected position; and a second tray engaging member movably coupled to the frame and movable relative to the frame and the second carton loading station between a first position with the second tray engaging member spaced apart from a second packing carton to engage a second selected filled tray and a second position with the second tray engaging member proximate to the second packing carton for loading the second selected filled tray into the second packing carton, the second tray engaging member being configured to selectively engage and disengage from the second selected filled tray; and a carton conveyor positioned between the first and second carton loading stations to receive the first and second cartons after the first and second cartons have been loaded.

30. A method for loading filled fruit or vegetable packing trays into a packing carton, comprising:

engaging a selected filled tray with tray engaging members of a carton loading apparatus, engaging the selected filled tray including rotating opposing tray engaging members away from each other about a first axis, moving the tray engaging members together toward the selected filled tray, rotating the tray engaging members toward each other about the first axis to move the tray engaging members closer to the selected filled tray, and pivoting each tray engaging member about a corresponding second axis transverse to the first axis to engage a portion of the tray engaging members with the selected filled tray;

positioning the selected filled tray proximate to an opening of the carton; and moving the tray engaging members and the selected filled tray as a unit toward the carton to position the selected tray within the carton.

31. The method of claim 30 wherein the tray engaging members include at least two tray engaging members and engaging the selected filled tray includes suspending the selected filled tray from the tray engaging members.

32. The method of claim 30 wherein moving the tray engaging members and the selected filled tray as a unit includes moving the tray engaging members and the selected filled tray in a generally downward direction.

33. The method of claim 30, further comprising moving the selected filled tray from a conveyor to a fixed tray platform and moving the selected filled tray from the fixed tray platform to a movable tray support member to position the selected filled tray relative to the tray engaging members.

34. The method of claim 33 wherein moving the selected filled tray from the fixed tray platform includes sliding the tray support member between the fixed tray platform and the selected filled tray.

35. The method of claim 30, further comprising moving the selected filled tray from a conveyor to a movable tray support member and moving the tray support member to a position at which the selected filled tray can be engaged by the tray engaging members.

36. The method of claim 30 wherein engaging the selected filled tray includes operating a tray head having the tray engaging members and pivoting at least some of the tray engaging members relative to the tray head to contact the tray engaging members with the selected filled tray to grasp the selected filled tray.

37. A method for loading filled fruit packing trays into a packing carton with a carton loading apparatus, comprising:

positioning the carton beneath a plurality of tray engaging members of the carton loading apparatus;

receiving a selected filled tray on a tray support and pivoting the tray support to align the selected filled tray between the tray engaging members and the carton;

engaging the selected filled tray on the tray support with the plurality of tray engaging members by pivoting the tray engaging members relative to the selected filled tray from a disengaged position to an engaged a position;

moving the tray support away from the selected filled tray so that the tray engaging members support the selected filled fruit packing tray;

lowering the tray engaging members and the selected filled fruit packing tray into the carton and pivoting the tray engaging members to the disengaged position to release the selected filled tray; and raising the tray engaging members out of the carton.

38. The method of claim 37, further comprising:

drawing a cushioning pad into engagement with a vacuum cup by applying a vacuum to the vacuum cup;

pivoting the vacuum cup to align the pad with the selected filled tray while the selected filled tray is in the carton; and releasing the vacuum to the vacuum cup to drop the pad onto the selected filled tray.

39. The method of claim 38 wherein dropping the pad onto the selected filled tray occurs while the carton remains positioned beneath the tray engaging members.

40. The method of claim 37 wherein engaging the selected filled tray includes positioning tapered ends of the tray engaging members around a periphery of the selected filled tray.

* * * * *